US008193705B2

(12) United States Patent
Manuela et al.

(10) Patent No.: US 8,193,705 B2
(45) Date of Patent: Jun. 5, 2012

(54) LAMINATED CONFORMAL SEAL FOR ELECTROLUMINESCENT DISPLAYS

(75) Inventors: Peter Manuela, Toronto (CA); Vincent Joseph Alfred Pugliese, Oakville (CA); Yoshida Isao, Ibaraki (JP); Hiroki Hamada, Osaka (JP); Abe Hisashi, Osaka (JP)

(73) Assignees: iFire IP Corporation, Oakville, Ontario, CA (US); Sanyo Electric Co., Ltd., Moriguchi-Shi, Osaka (JP)

( * ) Notice: Subject to any disclaimer, the term of this patent is extended or adjusted under 35 U.S.C. 154(b) by 341 days.

(21) Appl. No.: 11/554,901

(22) Filed: Oct. 31, 2006

(65) Prior Publication Data

US 2007/0103069 A1 May 10, 2007

Related U.S. Application Data

(60) Provisional application No. 60/732,136, filed on Nov. 2, 2005.

(51) Int. Cl.
*H05B 33/04* (2006.01)

(52) U.S. Cl. ..... 313/512; 313/503; 428/690

(58) Field of Classification Search ..... 313/500–512; 445/25; 428/690; 524/99
See application file for complete search history.

(56) References Cited

U.S. PATENT DOCUMENTS

| | | | | |
|---|---|---|---|---|
| 5,346,752 | A | 9/1994 | Sawada et al. | |
| 5,432,015 | A * | 7/1995 | Wu et al. | 428/690 |
| 5,909,081 | A | 6/1999 | Eida et al. | |
| 5,920,080 | A | 7/1999 | Jones | |
| 6,146,225 | A | 11/2000 | Sheats et al. | |
| 6,465,953 | B1 | 10/2002 | Duggal | |
| 6,563,263 | B1 | 5/2003 | Kawaguchi et al. | |
| 6,753,096 | B2 | 6/2004 | Duggal et al. | |
| 6,771,019 | B1 | 8/2004 | Wu et al. | |
| 6,891,330 | B2 | 5/2005 | Duggal et al. | |
| 6,896,979 | B2 | 5/2005 | Sawai et al. | |
| 7,294,439 | B2 | 11/2007 | Kawaguchi | |
| 2002/0094451 | A1 * | 7/2002 | Li et al. | 428/690 |
| 2004/0116555 | A1 | 6/2004 | Naruse et al. | |
| 2004/0135495 | A1 * | 7/2004 | Wu et al. | 313/503 |
| 2004/0195960 | A1 | 10/2004 | Czeremuszkin et al. | |
| 2004/0195967 | A1 * | 10/2004 | Padiyath et al. | 313/512 |
| 2005/0001543 | A1 | 1/2005 | Nomura et al. | |
| 2005/0017633 | A1 | 1/2005 | Miyadera | |
| 2005/0023976 | A1 | 2/2005 | Wang | |
| 2005/0079380 | A1 | 4/2005 | Iwanaga | |
| 2005/0084708 | A1 * | 4/2005 | Haoto et al. | 428/690 |
| 2005/0116637 | A1 | 6/2005 | Yoshizawa | |
| 2005/0261400 | A1 * | 11/2005 | Yang et al. | 524/99 |

FOREIGN PATENT DOCUMENTS

WO WO 2004/067676 A1 8/2004

* cited by examiner

*Primary Examiner* — Peter Macchiarolo
*Assistant Examiner* — Mary Ellen Bowman
(74) *Attorney, Agent, or Firm* — Fay Sharpe LLP

(57) ABSTRACT

The present invention is an electroluminescent display that incorporates a laminated seal that inhibits exposure of display components to atmospheric contaminants and to a sealing process for fabrication of the same. The sealed electroluminescent display comprises a substrate upon which is constructed a thick dielectric electroluminescent display covered by a laminated seal comprising a lower multi-functional polymer film and an upper inorganic film that provides a barrier layer to inhibit exposure of the electroluminescent display structure to an atmospheric contaminant.

23 Claims, 7 Drawing Sheets

LAMINATED CONFORMAL SEAL FOR ELECTROLUMINESCENT DISPLAYS

This application claims the benefit of Provisional Patent Application No. 60/732,136, filed Nov. 2, 2005, the disclosure of which is incorporated herein in its entirety, by reference.

FIELD OF THE INVENTION

The present invention relates to electroluminescent displays. In particular present invention relates to a laminated seal, methods of making therefore and a thick dielectric electroluminescent display incorporating the laminated seal. The laminated seal substantially inhibits the exposure of display components to at least one atmospheric contaminant and helps to getter vapour species evolved within the display.

BACKGROUND TO THE INVENTION

Full color thick film dielectric electroluminescent displays, employing thin film phosphors and thick film dielectric layers, provide a greater luminance and superior reliability over traditional thin film electroluminescent displays. However, thick film dielectric electroluminescent displays employ phosphor materials and insulator materials that are susceptible to degradation due to reaction with water and other atmospheric vapors. Furthermore, the thick film dielectric layer of such displays, which enhances the luminosity of the displays to usable levels, may also be susceptible to degradation due to reaction with these atmospheric contaminants and may act as a reservoir for water and other contaminants that may react adversely with the display structure during operation of the display. Atmospheric contaminants are known to shorten the life of electroluminescent displays and thus in order to protect and minimize damage to these electroluminescent displays various types of seals have been developed for incorporation into displays.

U.S. Pat. No. 6,771,019 (the disclosure of which is incorporated herein in its entirety by reference) discloses the use of perimeter seals in thick film dielectric electroluminescent displays. Briefly, thin film phosphors are typically sandwiched between a pair of addressable electrodes and fabricated on a heat resistant substrate that is also impervious to water and atmospheric contaminants. The phosphor materials are activated by application of an electric field generated between the electrodes. A chemically impervious cover plate is typically placed over the fabricated display and sealed between the substrate and the cover plate with a perimeter seal in order to protect the phosphor material, dielectric layers and electrodes between the substrate and the cover plate. In some cases, the cover plate is on the viewing side of the display, in which case it must be optically transparent, and in other cases, the display is constructed on an optically transparent viewing-side substrate and the cover plate is positioned opposite the viewing side.

To further minimize ingress of atmospheric contaminants into the display structure a desiccant may be incorporated into the perimeter seal between the display substrate and the cover plate as exemplified by Applicant's co-pending International Patent Application serial number WO2004/067676 (the disclosure of which is incorporated herein in its entirety), however, the desiccant has a finite capacity to absorb these contaminants.

Sealing layers have also been developed for use with other types of displays. For example, U.S. Pat. No. 5,920,080 discloses an organic light emitting device (OLED) constructed on a substrate that has incorporated a top cover structure that includes an amorphous carbon or silicon carbide moisture barrier layer above the top conductor of the OLED and a further sealing layer comprising a heat sink gel material containing a particulate moisture getter such as barium oxide above the moisture barrier layer. There is also a cover glass over the display substrate and bonded to the substrate to form a perimeter seal around each display.

U.S. Pat. No. 6,146,225 discloses a barrier for preventing water or oxygen from reaching an organic light emitting device. The barrier comprises layers of polymer having an inorganic layer comprising oxides, oxy-nitrides or nitrides therebetween. A getter material can be provided in the inorganic layer or as a separate layer between the polymer layers and the display, but the getter has a finite capacity to absorb contaminants.

U.S. Pat. No. 6,891,330 discloses an organic electroluminescent device, the surface of which is coated with a multilayer barrier coating of an organic polymer and inorganic material.

U.S. Pat. No. 6,896,979 discloses a film for use in organic EL devices which is made of an organic inorganic hybrid material. The film is used as a gas-barrier to encapsulate the device.

While the aforementioned references may teach the use of various types of seals and seal arrangements for electroluminescent displays, these seals and seal arrangements may not adequately immobilize the flux of atmospheric contaminants into the electroluminescent displays over the intended life of the display. They may also not adequately address the water and other contaminants that may reservoir within the thick film dielectric layer that may react adversely with the display structure during operation of the display. Therefore, there still remains a need for a proper seal and sealing process for thick film dielectric electroluminescent displays in order to improve their operating stability.

SUMMARY OF THE INVENTION

The invention is a laminated seal for thick film dielectric electroluminescent displays that functions to improve the operating and storage stability of the displays. The laminated seal comprises an inorganic layer overlaying and in contact with a polymer layer, where the laminated seal is provided at locations between the phosphor layer and the top cover viewing surface of a thick layer dielectric electroluminescent display. In aspects of the invention, the laminated seal comprises an inorganic layer overlaying a polymer layer, where the seal is provided over the upper electrodes of the display or alternatively over a color conversion layer that is used in conjunction with a blue light emitting phosphor film of the display. Still in alternate embodiments, the laminated seal comprises an inorganic layer overlaying a color conversion layer, where the seal is provided over a blue light emitting pixel array of the display. In this embodiment, the color conversion layer serves as the polymer layer portion of the seal.

The laminated seal may be provided as one inorganic layer and one polymer layer, for instance, one inorganic layer overlaying one polymer layer or, alternatively, as multiple and alternating polymer and inorganic layers where the overall thickness of the laminate is limited by the optical transmissivity of the film. In some cases, it may be desirable to have an inorganic layer as the first layer of the seal to achieve adequate adhesion of the seal to the underlying pixel array and to provide adequate wetting of the first polymer layer on the underlying pixel array. In this case the first inorganic layer would not provide a substantially pin hole free layer, but the second inorganic layer and any additional inorganic layers would be substantially pinhole free. In some cases it may also be desirable to overlay the topmost inorganic layer with an additional polymer layer to impart resistance to mechanical abrasion that may occur during handling and subsequent assembly of a display with the seal structure.

In embodiments of the invention, a perimeter seal may be used in conjunction with the laminated seal in a thick film dielectric electroluminescent display. The perimeter seal contacts and extends from the substrate of the display to the cover plate of the display to further minimize the flux of atmospheric contaminants that may negatively affect the electroluminescent display structure that is provided in between the cover plate and the substrate.

In accordance with an aspect of the present invention is a laminated seal for thick film dielectric electroluminescent displays. The laminated seal comprises:

an inorganic layer overlaying a polymer layer.

In aspects of the invention, the laminated seal is provided between an upper electrode of the display and the viewing surface. In other aspects, the laminated seal is provided over top and directly adjacent to a color conversion layer overlaying a blue light emitting pixel array. Still in further aspects, the polymer layer of the laminated seal is the color conversion layer and such laminated seal is provided over a blue light emitting addressable electroluminescent pixel array. The pixel array comprises a lower electrode, a thick dielectric layer, a blue light-emitting phosphor, an optional thin film dielectric layer thereon and an upper electrode.

In accordance with another aspect of the present invention is a laminated seal structure, the structure comprising;

an inorganic layer overlaying a polymer layer; and an electrode adjacent said polymer layer.

In aspects, the laminated seal may be multiply layered.

In accordance with another aspect of the present invention is a laminated seal structure, the structure comprising;

an inorganic layer overlaying a polymer layer; and a color conversion layer adjacent said polymer layer.

In aspects, the laminated seal may be multiply layered.

In accordance with yet another aspect of the present invention is a laminated seal structure, the structure comprising;

an inorganic layer overlaying a color conversion layer; and a blue light emitting phosphor layer adjacent said color conversion layer.

In aspects the laminated seal may be multiply layered

In accordance with still another aspect of the present invention there is provided an electroluminescent display, the display comprising a laminated seal structure selected from the group consisting of:

(i) an inorganic layer overlaying a polymer layer and an upper electrode adjacent said polymer layer;

(ii) an inorganic layer overlaying a polymer layer and a color conversion layer adjacent said polymer layer; and (iii) an inorganic layer overlaying a color conversion layer and a blue light emitting addressable electroluminescent pixel array adjacent said color conversion layer.

In aspects of the invention, the display is a thick film dielectric electroluminescent display. In any aspects of the invention where the display is a thick film dielectric electroluminescent display, the display may comprise a perimeter seal.

In accordance with a further aspect of the present invention there is provided an electroluminescent display comprising:

a substrate;

a transparent cover plate;

a blue light-emitting addressable electroluminescent pixel array between said substrate and said cover plate; and a laminated seal comprising a photoluminescent color conversion layer that converts blue light from at least some of the pixels in the pixel array to visible light of a different color in proximity to and aligned with the sub-pixels of said pixel array and an optically transparent inorganic layer adhered to said color conversion layer.

The pixel array comprises in sequence: a lower electrode; a thick film dielectric layer; a smoothing layer; a thin film dielectric layer; phosphor layer; upper thin film dielectric layer; and upper electrode.

In aspects, the display may further comprise a perimeter seal contacting and extending from said substrate and to said cover plate to inhibit exposure of the electroluminescent pixel array to an atmospheric contaminant.

In accordance with a still further aspect of the present invention, there is provided a sealed electroluminescent display comprising:

a substrate;

a cover plate;

a blue light-emitting addressable electroluminescent pixel array between said substrate and said cover plate;

a photoluminescent color conversion layer that converts blue light from at least some of the pixels in the pixel array to visible light of a different color adhered to and aligned with the sub-pixels of said pixel array;

a laminated seal provided over and in contact with said color conversion layer, wherein the laminated seal comprises a polymer layer adhered to said pixel array and an optically transparent inorganic sealing layer adhered to said polymer layer.

In aspects, the display is a thick film dielectric electroluminescent display. Also in aspects, the display may further comprise a perimeter seal contacting and extending from said substrate and to said cover plate to inhibit exposure of the electroluminescent pixel array to an atmospheric contaminant.

In accordance with a still further aspect of the present invention, there is provided a sealed electroluminescent display comprising:

a substrate;

a cover plate;

a blue light-emitting addressable electroluminescent pixel array between said substrate and said cover plate;

a perimeter seal contacting and extending from said substrate and to said cover plate to inhibit exposure of the electroluminescent pixel array to an atmospheric contaminant;

an optically transparent bilayer sealing structure that comprises a lower planarizing polymer layer deposited on and adhered to said pixel array and an upper inorganic sealing layer deposited on said lower polymer layer;

a photoluminescent color conversion layer that converts blue light from at least some of the pixels in the pixel array to a different color of visible light and adhered to the bilayer sealing structure and aligned with the sub-pixels of said pixel array; and an optically transparent inorganic sealing layer adhered to said color conversion layer.

In accordance with another aspect of the present invention, there is provided a sealed electroluminescent display comprising:

a substrate;

a cover plate;

an electroluminescent pixel array between the substrate and the cover plate comprising a thick film dielectric layer and a blue-light emitting phosphor layer;

a perimeter seal contacting and extending from the substrate and to the cover plate to inhibit exposure of the electroluminescent pixel array to an atmospheric contaminant; and a multi-layer sealing structure on the display that comprises alternating polymer layers and inorganic layers deposited over the underlying pixel array.

In accordance with another aspect of the present invention, there is provided a sealed electroluminescent display comprising:

a substrate;

a thick film dielectric electroluminescent pixel array provided on the substrate;

a laminated seal structure within the display provided above said thick film dielectric electroluminescent pixel array, the seal structure comprising a lower layer deposited on the array of upper conductors of the display and an upper moisture impervious layer deposited on the lower layer, wherein the lower layer of the seal structure provides a means to absorb or react with vapors emanating from the pixel array so as to substantially prevent a build-up of pressure between the upper moisture impervious layer of the sealing structure and the pixel array that may cause fracture of the upper moisture-impervious layer.

In accordance with yet another aspect of the present invention, there is provided a sealed electroluminescent display comprising:

a substrate;

an electroluminescent pixel array provided on the substrate; and a seal structure on the display that comprises a lower layer deposited on an array of upper conductors of the display and an upper moisture impervious layer deposited on the lower layer, wherein the lower layer of the seal structure provides a means for mechanical stress relief between the moisture impervious layer of the seal structure and the pixel array that may cause fracture of the upper moisture-impervious layer.

In accordance with another aspect of the present invention, there is provided a process for making a sealed electroluminescent display having a substrate and an electroluminescent pixel array comprising a laminated seal structure, the process comprising:

depositing a liquid or slurry precursor layer adjacent to the top electrode array of the display and curing the deposited layer to form a polymer layer such that it has a smooth upper surface to facilitate subsequent deposition of a smooth substantially pinhole free thin film inorganic layer; and vacuum depositing a substantially pinhole-free inorganic thin film onto the organic layer.

In an aspect, the liquid or slurry is a monomer-containing liquid or slurry. In another aspect, the liquid or slurry precursor layer is deposited by spreading the monomer-containing liquid or slurry adjacent to the top electrode array of the display.

In accordance with another aspect of the present invention, there is provided a process for making a sealed electroluminescent display having a substrate and an electroluminescent pixel array comprising a laminated seal, the process comprising:

depositing a precursor layer by condensing a vapor adjacent to the top electrode array of the display and curing the deposited layer to form a polymer layer such that it has a smooth upper surface to facilitate subsequent deposition of a smooth substantially pinhole free thin film inorganic layer; and vacuum depositing a substantially pinhole-free inorganic thin film onto the organic layer.

In an aspect, the vapor is a monomer-containing vapor.

According to another aspect of the invention is a process for making a sealed electroluminescent display having a substrate and an electroluminescent structure comprising a laminated seal as described herein in any embodiment, the process comprising:

printing a lacquer formulation for a UV curable polymer adjacent said upper electrode and curing said printed formulation to provide a polymer layer having a smooth upper surface to facilitate subsequent deposition of a smooth and substantially pinhole-free inorganic layer; and vacuum depositing said inorganic layer onto said polymer layer.

Other features and advantages of the present invention will become apparent from the following detailed description. It should be understood, however, that the detailed description and the specific examples while indicating embodiments of the invention are given by way of illustration only, since various changes and modifications within the spirit and scope of the invention will become apparent to those skilled in the art from the detailed description.

BRIEF DESCRIPTION OF THE DRAWINGS

The present invention will become more fully understood from the detailed description given herein and from the accompanying drawings, which are given by way of illustration only and do not limit the intended scope of the invention.

DETAILED DESCRIPTION OF THE PREFERRED EMBODIMENTS

Figure 1A:
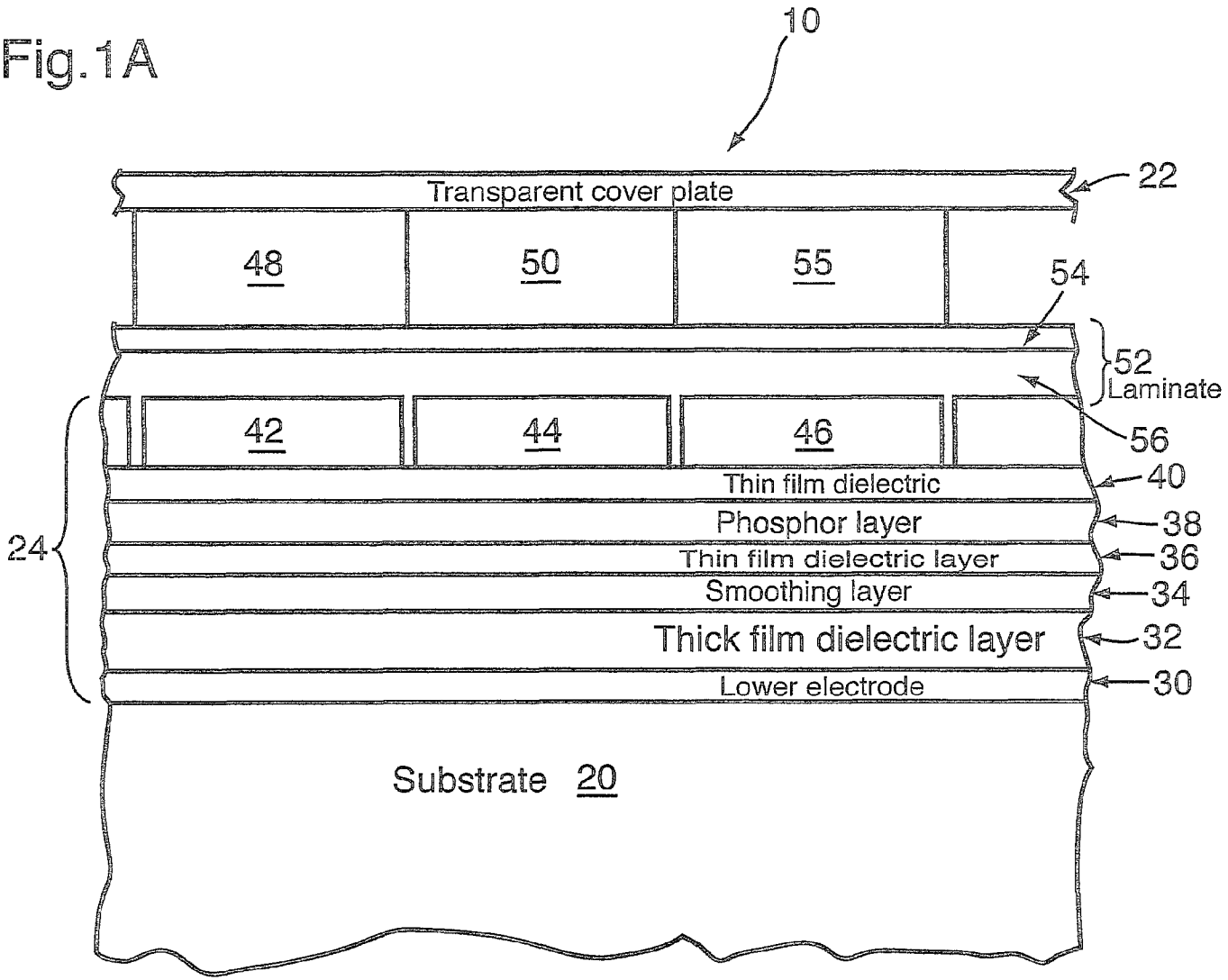
FIG. 1A is a cross sectional view of a sub-pixel portion of an electroluminescent display in accordance with one embodiment of the present invention incorporating one aspect of the laminated seal of the present invention.

The invention is directed to a laminated seal, laminated seal structure and processes for making such for use in electroluminescent displays and in aspects, for thick film dielectric electroluminescent displays.

The laminated seal of the invention comprises an upper inorganic layer and a lower polymer layer, where the lower polymer layer may be a color conversion layer. The laminated seal is provided in contact and over the upper electrode array of the display or alternatively over top and in contact with a color conversion layer provided over a blue light emitting phosphor. Still, the polymer layer of the laminated seal may itself be a color conversion layer.

The polymer layer provides for a planarized surface upon which a uniformly smooth substantially pin hole free upper inorganic layer is deposited that serves as an effective barrier to moisture and other contaminants from the ambient environment. The polymer layer and the inorganic layer of the laminated seal are directly adjacent and in contact with one other. The bilayer structure of the laminated seal of the invention maintains its integrity as the display is operated due to its resistance to rupture when volatile species are evolved from the display structure as it ages.

The laminated seal may be provided as three or more alternating polymer and inorganic layers where the maximum thickness of the laminate is limited by the optical transmissivity of the film but where the total seal thickness should be less than the sub-pixel width to avoid optical parallax effects. When provided as two or more layers of the laminated seal and the polymer bottom layer is the color conversion layer, then the one or more additional layers of laminated seals used incorporate a polymer layer which is not a color conversion layer.

In an embodiment of the invention, the laminated seal comprises a lower polymer layer and an upper moisture-impervious inorganic layer. The polymer layer is pliable so that it provides mechanical stress relief between the display structure and the inorganic moisture impervious layer. Furthermore, the polymer layer absorbs vapors evolved from the display structure as it ages and as it is operated to prevent rupture of the inorganic moisture-impervious layer due to build up of gas pressure within the structure.

In another embodiment of the invention, the polymer layer for the laminated seal comprises a multi-functional layer that provides two or more functions selected from the provision of a color conversion function, the provision of stress relief between the display structure and the moisture-impervious inorganic layer, the provision of a planarized surface for deposition of said moisture-impervious inorganic layer and the provision of a getter or absorbent for vapors or gases generated from the internal display structure during its operation. The surface of the polymer layer should be sufficiently smooth that a thin film inorganic layer can be vacuum deposited on top of it so that it does not substantially have pinholes or other mechanical defects that may act as a conduit for water transport across the layer.

The upper inorganic layer comprises a material selected from the group consisting of inorganic metal oxides, metal nitrides, metal oxynitrides, metal oxyborides, metal silicides, metal silicates and metal carbides, or combinations thereof preferably in the form of amorphous films to avoid rapid diffusion of atomic or molecular species through grain boundaries that are present in polycrystalline materials. More specifically, the upper inorganic barrier layer may be selected from the group consisting of silica, alumina, titania, indium oxide, tin oxide, indium tin oxide, tantalum oxide, zirconium oxide, chromium oxide, zinc oxide, aluminum nitride, silicon nitride, boron nitride, germanium nitride, chromium nitride, nickel nitride, boron carbide, tungsten carbide, silicon carbide, aluminum oxynitride, silicon oxynitride, boron oxynitride, zirconium oxyboride, titaniumoxyboride, silicon aluminum oxynitrode (SiAlON), aluminum oxynitride (AlON) and combinations thereof. The upper inorganic material in aspects is silicon nitride or silicon oxynitride. The thickness of the upper inorganic layer is determined on the basis that the film needs to be continuous, and needs to provide an adequate barrier to deleterious species originating from the ambient environment, or the environment sealed within the perimeter seal joining the display substrate to the cover plate. In aspects the thickness of the upper inorganic layer may range from about 0.01 to 2 micrometers (and any range thereinbetween), and in further aspects from about 0.05 to 1 micrometers (and any range thereinbetween).

The lower polymer layer comprises a material selected from the group consisting of optically transparent urethanes, polyamides, acrylates, polyimides, polybutylenes, isobutylenes, isobutylene isoprene, polyolefins, epoxies, parylene, benzocyclobutadiene, polynorborenes, polyarylethers, polycarbonate, alkyds, polyaniline, ethylenevinyl acetate and ethylene acrylic acid, polystyrenes, polyesters, silicones, polysilicones, polyphosphazenes, polysilazane, polycarbosilane, polycarborane, carborane silioxanes, polysilanes, phosphonitriles, sulfur nitride polymers and siloxanes and combinations thereof. In aspects of the invention, the lower polymer layer may be a color conversion layer as is described in Applicant's PCT CA2005/000756 (the disclosure of which is incorporated by reference herein in its entirety by reference). Briefly, such a color conversion layer comprises a fluorescent pigment particle composition dispersed within a UV curable resin. The fluorescent pigment particles are made of a composition comprising at least one dye and a polymeric material to which in one aspect of the invention, a molecular additive is further added such as ultraviolet absorbers (UVAs) and light stabilizers such as hindered amine light stabilizers (HALS) and nickel compounds. The UVAs are selected to preferentially absorb ultraviolet light without hindering the ability of the photoinitiators used in the resin to be activated with UV light and to minimize the absorption of blue light. The fluorescent pigment particles are then mixed and dispersed throughout a clear UV curable resin, such as an acrylated melamine resin that comprises a photo-initiator to form a paste to effect patterning thereof. The color conversion layer is provided as a paste which is deposited as a uniform film and then patterned onto an electroluminescent panel using photolithographic methods known in the art. Typically, one color converting photoluminescent layer is used for red and one layer is used for green with the layer composition being different for red and green. The paste is deposited to form a uniform layer of a first color conversion photoluminescent layer (for example green) onto a sub-pixel array using screen printing techniques or other methods as known to those of skill in the art. The sub-pixel array is such as that disclosed in the Applicants PCT Application PCT CA03/01567 (the disclosure of which is incorporated herein by reference in its entirety). The uniform screen printed film is exposed to a UV light through a photomask with the desired pixel pattern to activate the photoinitiator to cure the resin and then dissolve the unexposed portion in a solvent (as described in Applicants PCT Patent Application PCT CA03/01567), the entirety of which is incorporated herein by reference) to establish the desired pattern for the first color conversion photoluminescent layer. This process is then repeated with the second color conversion photoluminescent layer. After UV curing, the layer or layers may be further exposed to a thermal bake to eliminate monomers, residual photo-initiators, oligomers and other volatile species by out-diffusion and evaporation. Thermal curing may be done at a temperature range of about 80° C. to about 160° C. (and any range therebetween) for about 2 or more hours.

The thickness of the lower polymer layer which may be also a color conversion layer is determined based on the optical absorption properties of the layer. Thickness of the polymer layer is selected on the basis of the thickness required to obtain a sufficiently smooth surface to deposit the pinhole free inorganic layer, and in the case where a getter is incorporated into the polymer layer as is discussed below, the thickness is sufficient to contain an adequate quantity of getter based on the expected quantity of evolved gas from the display structure that needs to be absorbed during display operation as is understood by one of skill in the art. If the polymer layer and the color conversion layer are the same layer, then the thickness requirements must be compatible and such requirements can be readily determined by one of skill in the art.

The polymer layer may additionally comprise organic or inorganic getter materials in particulate form to increase the ability of the sealing structure to consume vapors evolved from the display structure. The concentration of the getter material for use in the lower polymer layer may be about 5% to about 50% of the sealing material volume and in aspects, between about 10 and about 30% of the lower polymer layer material volume. In further aspects, the getter material has a particle size that should not exceed the thickness of the lower polymer layer. In aspects, the getter material has a particle size in the range of from about 0.1 to about 0.25 micrometers.

In other aspects of the invention, the getter material is selected from the group consisting of alkali metal oxides, alkali metal sulfates, alkaline earth metal oxides, alkaline earth metal sulfates, calcium chloride, lithium chloride, zinc chloride, perchlorates and mixtures thereof. The getter material may also be selected from the group consisting of molecular sieves, calcium oxide, barium oxide, phosphorus pentoxide, calcium sulfate and mixtures thereof. A getter material should be selected so that it does not significantly reduce the optical transparency of the laminated seal. To this end the size of the getter particles should be significantly less that the wavelength of the light that it transmitted or have an optical index of refraction close to that of the polymer layer of the laminated seal. Alternatively, the getter can be dispersed in areas of the laminated seal that are not required to transmit light, but this is not a preferred solution as additional process steps may be required to distribute the getter in this way.

In aspects, the maximum loading of getter material per unit volume of the polymer layer of the laminated seal is about 50%, in further aspects at least about 5%. In aspects the getter material concentrations are between about 10% and about 30% of the sealing material volume, and most preferably between about 15% and about 25% of the polymer material volume. Ideally, the getter material is uniformly distributed throughout the polymer layer of the sealing structure.

Getter materials are any atmospheric contaminant-immobilizing materials, for example, materials that absorb water. Suitable getter materials include, but are not limited to, alkali metal oxides, alkali metal sulfates, alkaline earth metal oxides, alkaline earth metal sulfates, calcium chloride, lithium chloride, zinc chloride, perchlorates and mixtures thereof. Preferred getter materials include molecular sieves, calcium oxide, barium oxide, phosphorus pentoxide, calcium sulfate and mixtures thereof.

The getter material may have a particle size in the range of from about 0.1 to about 250 micrometers, depending on the seal thickness. Preferably, the particle size is selected so that it is sufficiently small such that the spacing between the particles is sufficiently small that vapors will readily come into contact with the getter particles during their transit within the polymer layer of the sealing structure.

The laminated seal of the invention is used/for a thick film dielectric electroluminescent display that is typically constructed on a glass, glass ceramic, ceramic, or other heat resistant substrate or the like. The fabrication process for the display entails first depositing a set of lower electrodes on the substrate. A thick film dielectric layer is then deposited thereon using thick film deposition techniques that are exemplified in U.S. Pat. No. 6,771,019 (the disclosure of which is incorporated herein by reference in its entirety). Typically, the thick film layer comprises a sintered perovskite piezoelectric or ferroelectric material such as lead magnesium niobate (PMN) or lead magnesium titanate-zirconate (PMN-PT) with a dielectric constant of several thousand. There may also be a thinner overlayer (a smoothing layer) of a compatible piezoelectric or ferroelectric material such as lead zirconate titanate (PZT) applied using metal organic deposition (MOD) or sol gel techniques to smooth the thick film surface for deposition of a thin film phosphor structure. The Applicant's U.S. Pat. No. 5,432,015 (the disclosure of which is incorporated herein by reference in its entirety) discloses thick film dielectric composite structures for use in electroluminescent displays. The thick film dielectric layer may further be mechanically compressed as is described in the Applicant's PCT patent application Serial No. WO00/70917 (the disclosure of which is incorporated herein by reference in its entirety). Furthermore, the Applicant's International Patent Application PCT CA02/01932 (the disclosure of which is incorporated herein by reference in its entirety) discloses a modified thick film paste formulation used to make a thick film dielectric layer. This modified thick film dielectric layer may be sintered at temperatures as low as 650° C. to facilitate the use of a glass substrate and can be used as the thick film dielectric in the present invention.

Over the thick film dielectric layer a thin film structure comprising one or more thin film dielectric layers as described in the Applicants U.S. Pat. No. 6,589,674 (the disclosure of which is incorporated herein in its entirety) such as for example made of barium titanate sandwiching one or more thin phosphor films is then deposited, followed by a set of optically transparent upper electrodes using vacuum techniques as exemplified in U.S. patent application Ser. No. 2004/0013906 (the disclosure of which is incorporated herein in its entirety). A further embodiment of a full color thick dielectric electroluminescent display is exemplified by U.S. patent application publication No. 2004/0135495 (the disclosure of which is incorporated herein in its entirety) whereby the sub-pixels for red, green and blue comprise blue emitting electroluminescent elements which serve directly as the emitted light source for blue sub-pixels and which activate red and green photoluminescent color conversion films that overlay the blue-emitting elements that are activated by the blue emitting elements and provide respectively the emitted light for red and green sub-pixels.

For thick dielectric electroluminescent displays that incorporate color conversion layers for red and green sub-pixels, the color conversion layers may be disposed over top of the electroluminescent sub-pixel structure. The electroluminescent sub-pixel structure comprises those elements provided over top of the substrate including the sub-pixel columns. In this aspect for the sealing structure of this invention, the lower polymer layer may be the color conversion layer to provide both the function of the color conversion layer and the stress relief or vapor absorption functions of the present invention.

It is also understood however, to one of skill in the art that the laminated seal structure may be incorporated in a thick film dielectric electroluminescent display in which there is no color conversion layer(s) used but rather the phosphor layer provided within the display is patterned. In this embodiment, the laminated seal structure is provided over the upper electrodes of the display but not directly over the patterned phosphor. Reference is made to FIGS. 1A to 3 which illustrate different embodiments of a full color thick dielectric electroluminescent display incorporating color conversion layers and the laminated seal of the present invention. It is noted that the figures are not to scale and show a representative sequence and arrangement of layers provided within the thick film dielectric electroluminescent display incorporating the laminated seal of the present invention. The layers shown therein are also representative and are not illustrative of the actual or relative thickness of the layers viz-a-viz other layers. It is also understood by those of skill in the art that the displays shown in the figures may incorporate other layers such as for example those described in Applicant's co-pending U.S. Ser. Nos. 10/661,910, 10/736,020 and 10/736,368 as well as in Applicant's co-pending PCT CA2005/001151 (the disclosures of which are hereby incorporated by reference in their entirety).

In FIG. 1A, a portion of a sub-pixel structure of an electroluminescent display is generally indicated by reference numeral 10. The electroluminescent display 10 has a substrate 20, a cover plate 22, an electroluminescent display structure 24 therebetween and an optional perimeter seal (not shown) between the substrate 20 and the cover plate 22 for providing a measure of protection for the electroluminescent display structure 24 (also referred to as a blue light-emitting addressable electroluminescent pixel array) from one or more atmospheric contaminants. A perimeter seal extends and is in contact with the cover plate 22 and the substrate 20 and thus fills the entire gap between the cover plate 22 and the substrate 20 only on the outside perimeter of the display. The perimeter seal does not contact the electroluminescent display structure 24 and is described in detail in Applicant's co-pending U.S. application Ser. No. 10/885,257 (the disclosure of which is hereby incorporated by reference in its entirety). The substrate 20 has a lower electrode 30 located thereon, followed by a thick film dielectric layer 32 and then a dielectric smoothing layer 34 and an optional thin film dielectric layer 36 thereon made of a material such as for example barium titanate. A blue light-emitting phosphor layer 38 is provided on the thin film dielectric layer to which an upper thin film dielectric layer 40 is shown, and made of a material such as for example aluminum nitride, with three sub-pixel columns 42, 44, and 46 located thereon. These sub-pixel columns facilitate the application of a voltage to cause the phosphor layer to luminesce. The upper thin film dielectric layer 40 separates the sub-pixel columns 42, 44 and 46 from the phosphor layer 38. Sub-Pixel column 42 has a green color conversion layer 48 located above it. Similarly, sub-pixel column 44 has red color conversion layer 50 located above it. Sub-pixel column 46 corresponding to a blue sub-pixel has no color conversion layer, but rather has an optically transparent layer 55 having an optical index of refraction chosen to minimize optical reflections between layers. The cover plate 22 is disposed over the substrate facing the deposited layers and may be sealed to the substrate with the perimeter seal. The laminated seal 52 of the invention in this embodiment is shown to be provided over the upper electrodes of the display and comprises an inorganic layer 54 over a polymer layer 56.

Figure 1B:
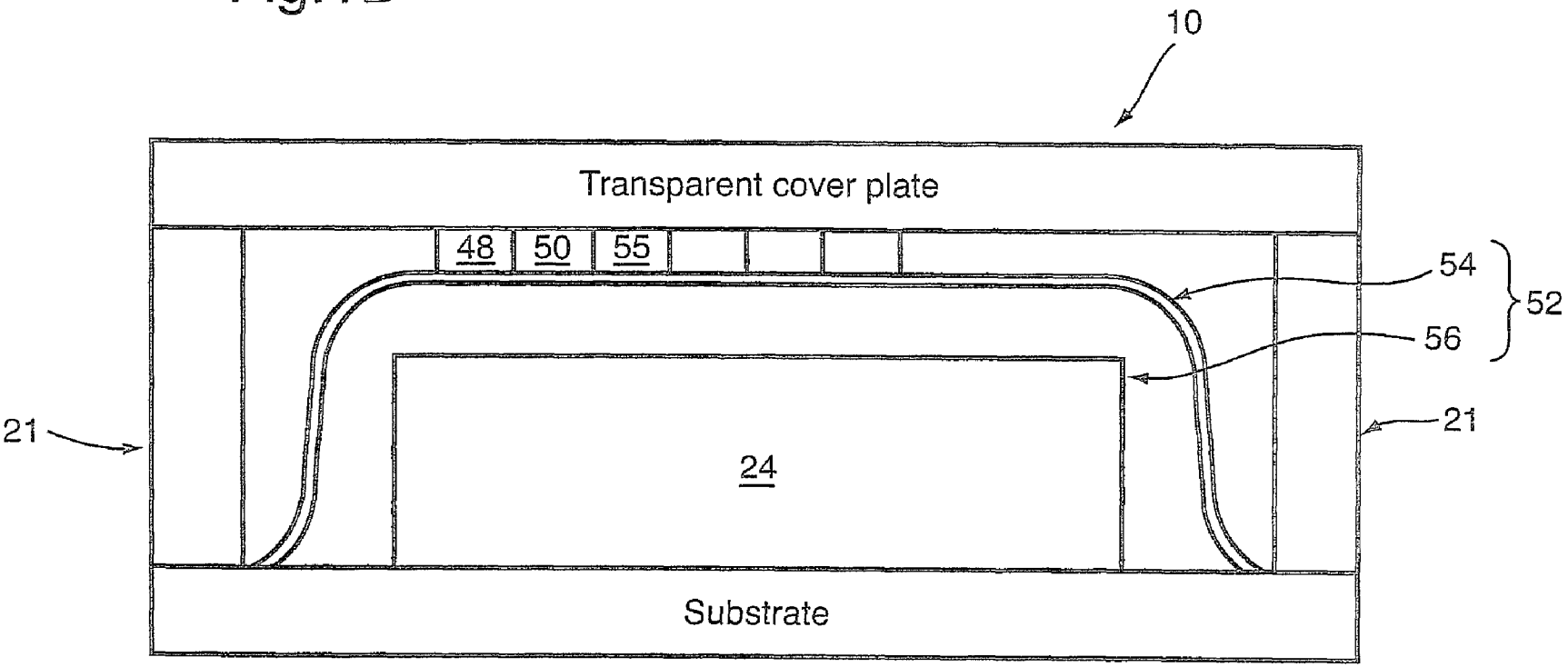
FIG. 1B is a cross sectional view of an entire electroluminescent display of figure 1A.

FIG. 1B shows a cross-section of the display of FIG. 1A showing the laminated seal covering the entire electroluminescent display structure. A perimeter seal 21 is shown in this embodiment extending from the substrate to the transparent cover plate 22.

Figure 2:
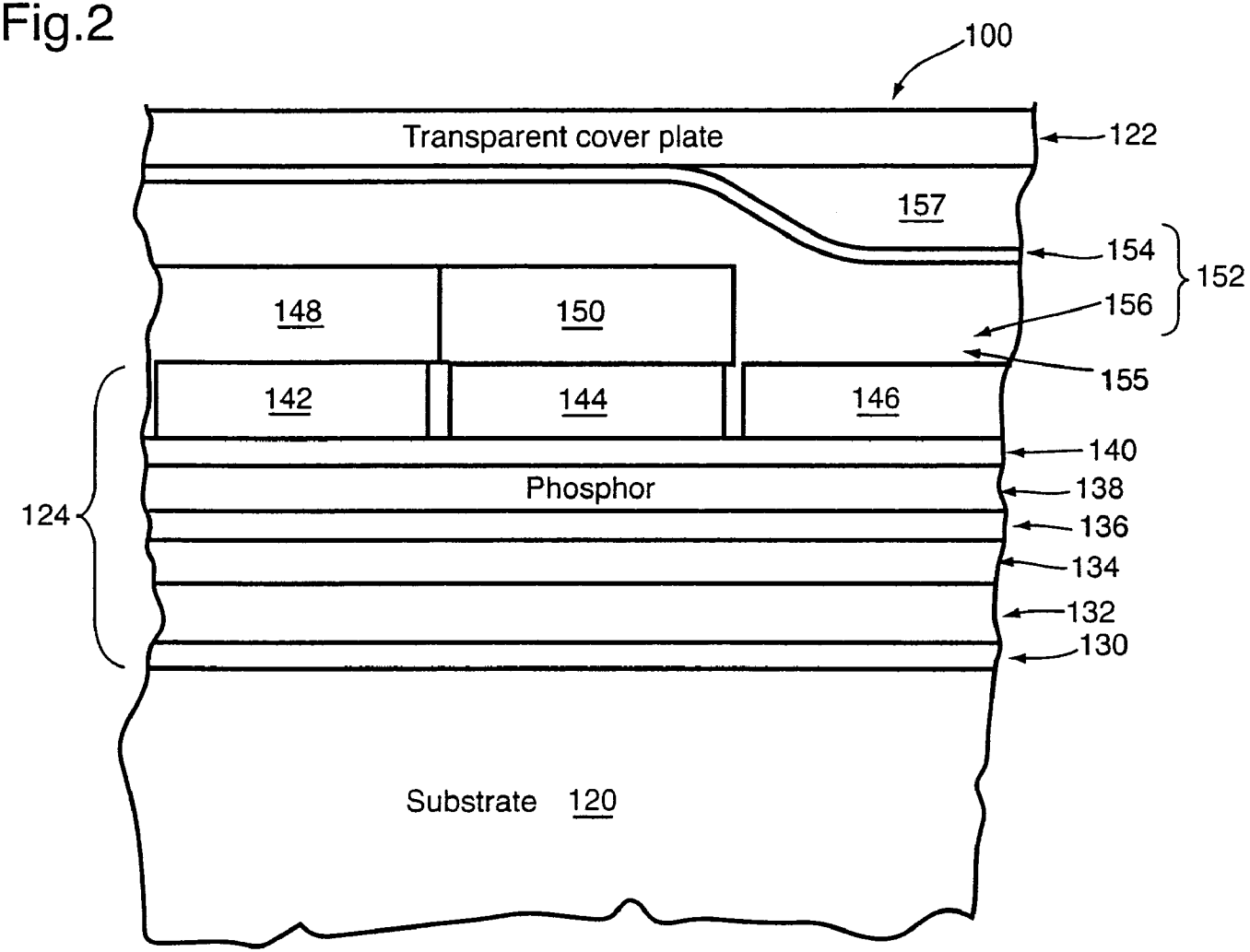
FIG. 2 is a cross sectional view of a sub-pixel portion of an electroluminescent display incorporating another embodiment of the laminated seal of the invention.

FIG. 2 shows a further embodiment of a portion of a sub-pixel structure of a thick film dielectric electroluminescent display 100 where the laminated seal 152 is provided over the color conversion layers 148, 150 and blue sub-pixel 146 of the display. Again, in this embodiment the electroluminescent display 100 has a substrate 120, a cover plate 122, an electroluminescent display structure 124 therebetween and an optional perimeter seal (not shown) between the substrate 120 and the cover plate 122 for providing a measure of protection for the electroluminescent display structure 124 from one or more atmospheric contaminants. A perimeter seal extends and is in contact with the cover plate 122 and the substrate 120 and thus fills the entire gap between the cover plate 122 and the substrate 120. The perimeter seal does not contact the electroluminescent display structure 124. The substrate 120 has a lower electrode 130 located thereon, followed by a thick film dielectric layer 132 and then a dielectric smoothing layer 134 and an optional thin film dielectric layer 136 thereon made of a material such as for example barium titanate. A blue light-emitting phosphor layer 138 is provided on the thin film dielectric layer 136 to which an upper thin film dielectric layer 140 is shown with three sub-pixel columns 142, 144, and 146 located thereon. These sub-pixel columns facilitate the application of a voltage to cause the phosphor layer to luminance. The thin film dielectric layer 140 separates the sub-pixel columns 142, 144 and 146 from the phosphor layer 138. Sub-pixel column 142 has a green color conversion layer 148 located directly above it. Similarly, sub-pixel column 144 has red color conversion layer 150 located directly above it. Sub-pixel column 146 corresponding to a blue sub-pixel has no color conversion layer. Instead the laminated seal 152 is provided over top of the color conversion layers 148 and 150 and directly over the sub-pixel column 146. The laminated seal 152 comprises an inorganic layer 154 over top of a polymer layer 156. The laminated seal 152 is shown to fill in void 155 where no color conversion layer is provided, and as such fills in this space. A void 157 provided over top of the laminated seal 152 can be filled with an optically transparent non-reactive material or alternatively, the laminated seal 152 can also be provided such that it fills this void 157. The cover plate 122 is disposed over the substrate facing the deposited layers and is sealed to the substrate with the perimeter seal.

Figure 3:
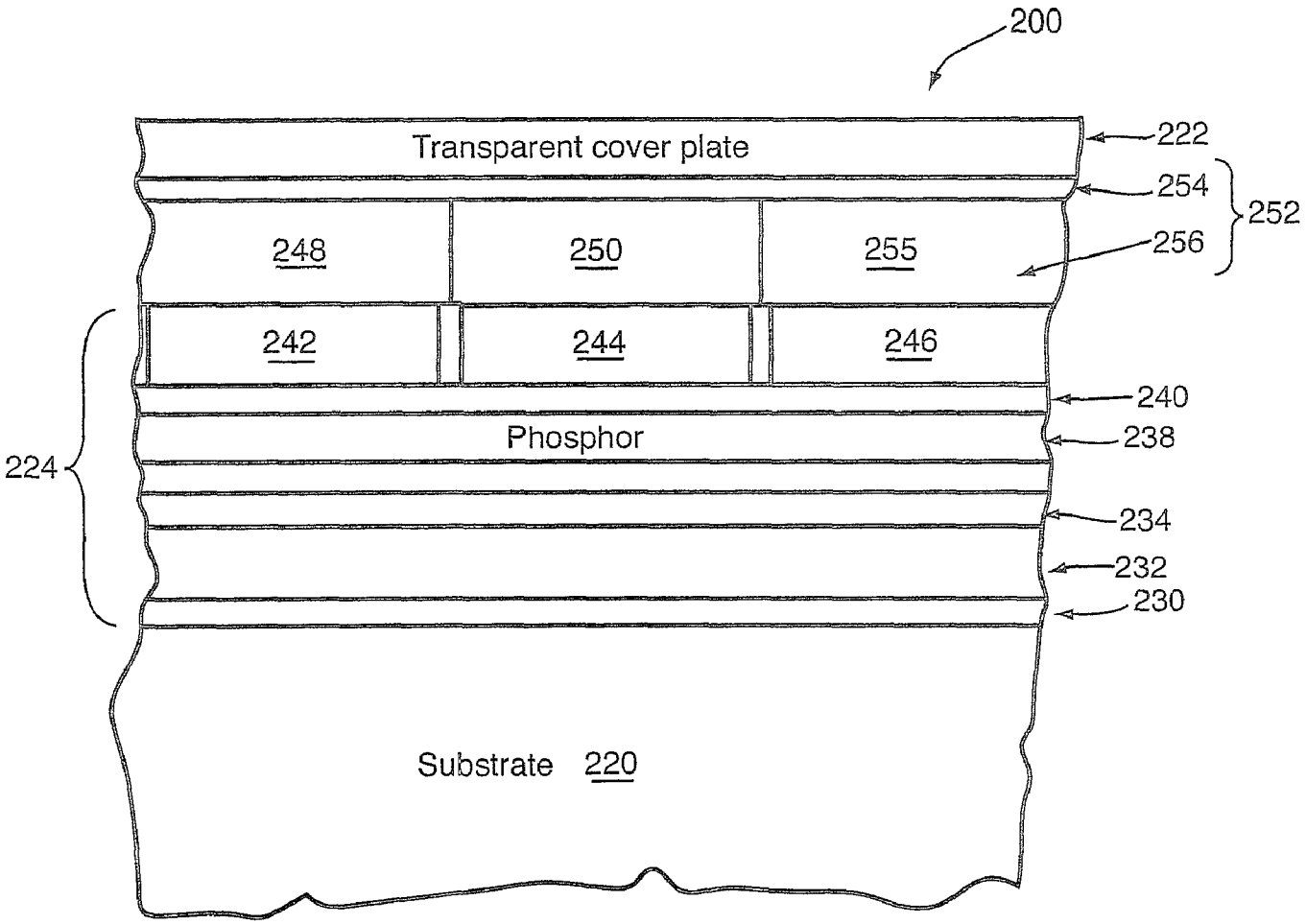
FIG. 3 is a cross sectional view of a sub-pixel portion of an electroluminescent display incorporating still another embodiment of the laminated seal of the invention.

FIG. 3 shows a further embodiment of a portion of a sub-pixel of a thick film dielectric electroluminescent display 200 where the display incorporates the laminated seal 252 of the present invention with the polymer bottom layer incorporating the color conversion layer 248 and 250. Again, in this embodiment the electroluminescent display 200 has a substrate 220, a cover plate 222, an electroluminescent display structure 224 therebetween and an optional perimeter seal (not shown) between the substrate 220 and the cover plate 222 for providing a measure of protection for the electroluminescent display structure 224 from one or more atmospheric contaminants. A perimeter seal extends and is in contact with the cover plate 222 and the substrate 220 and thus fills the entire gap between the cover plate 222 and the substrate 220. The perimeter seal does not contact the electroluminescent display structure 224. The substrate 220 has a lower electrode 230 located thereon, followed by a thick film dielectric layer 232 and then a dielectric smoothing layer 234 and an optional thin film dielectric layer 236 thereon made of a material such as barium titanate. A phosphor layer 238 is provided on the thin film dielectric to which an upper thin film dielectric layer 240 is shown with three sub-pixel columns 242, 244, and 246 located thereon. These sub-pixel columns facilitate the application of a voltage to cause the phosphor layer to luminance. The thin film dielectric layer 240 separates the sub-pixel columns 242, 244 and 246 from the phosphor layer 238. Sub-pixel column 242 has a green color conversion layer 248 located above it. Similarly, sub-pixel column 244 has red color conversion layer 250 located above it. Sub-pixel column 246 corresponding to a blue sub-pixel has no color conversion layer but it has an optically transparent component 255 of the polymer bottom material having an optical index of refraction chosen to minimize reflections between the layers and to provide a smooth surface over all of the sub-pixels for subsequent deposition of the inorganic layer. This component may be an optical blue filter or void as well. The cover plate 222 is disposed over the substrate facing the deposited layers and is sealed to the substrate with the perimeter seal.

It is understood by one of skill in the art, that any gaps provided within the device may be filled with a suitable transparent polymer material.

In an embodiment of the process for making the sealed electroluminescent display of the present invention, the liquid or paste precursor material for the polymer layer of the sealing structure material is prepared in a contaminant-free atmosphere, such as in a dry box, to avoid contaminating the getter material with moisture such that the getter material is deactivated (when getter material is incorporated). The loading of the getter material into the sealing material may be adjusted in order to achieve the desired contaminant absorbing capacity and contaminant absorbing efficiency. Deposition and curing should also be carried out in the dry box to prevent moisture contamination. In aspects of the method of the invention, the UV curable polymer layer is printed to the top of the electrode array as a lacquer formulation. Printing can be done in a variety of manners including but not limited to indirect offset printing or roll coating. This polymer layer is then cured such that it has a smooth upper surface to facilitate subsequent deposition of a smooth and substantially pinhole-free thin film inorganic layer. The substantially pinhole-free inorganic layer is then vacuum deposited onto the polymer layer.

The above disclosure generally describes preferred embodiments of the present invention. A more complete understanding can be obtained by reference to the following specific Examples. These Examples are described solely for purposes of illustration and are not intended to limit the scope of the invention. Changes in form and substitution of equivalents are contemplated as circumstances may suggest or render expedient. Although specific terms have been employed herein, such terms are intended in a descriptive sense and not for purposes of limitation.

EXAMPLES

Example 1

Demonstrates the efficacy of different laminated seal configurations on the operating stability of a test electroluminescent device.

Figure 4:
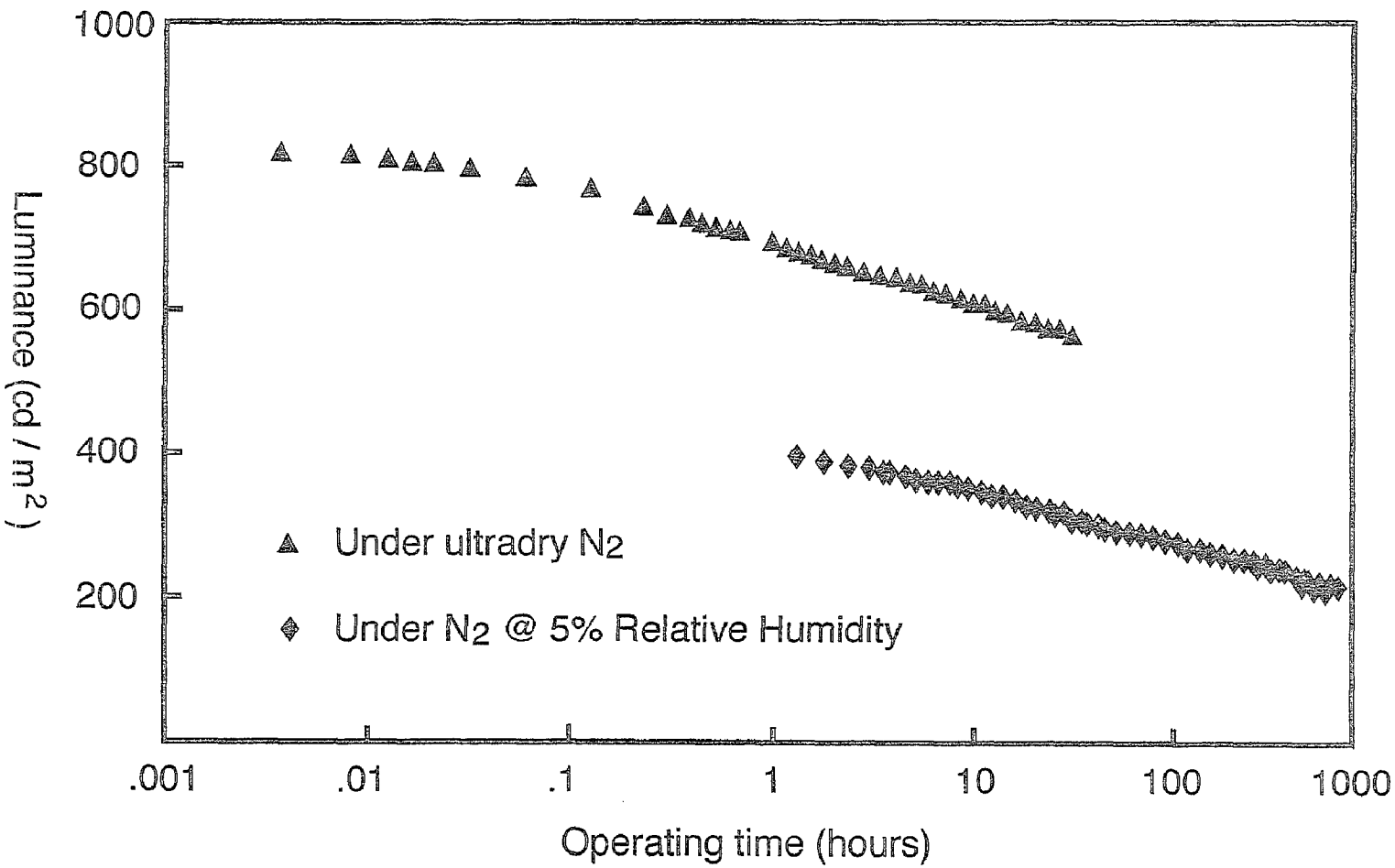
FIG. 4 is a graph illustrating the luminosity of thick film dielectric electroluminescent displays of the prior art operated in ambient atmospheres with different relative humidities.

Two test electroluminescent devices each having a thick dielectric and a blue-emitting europium activated barium thioaluminate thin film phosphor, as exemplified in International Patent Applications WO 00/70917, WO 02/058438 and U.S. Provisional Application 60/434,639 (the disclosures of which are incorporated herein by reference) were constructed on 5 centimeter by 5 centimeter glass substrates. One device was sealed with a resin coating consisting of Fuji acrylic resin CT2000L from Arch Chemicals of Norwalk Conn. deposited using a spin coating process, dried at 100° C. for 10 minutes, UV cured under an ultraviolet flux of 400 milliJoules per square centimeter and baked at a temperature of 160° C. for 1 hour. The other device was not covered with a polymer layer. The device without the polymer layer was operated in an ambient environment comprising nitrogen at 5% relative humidity and the other device with the polymer layer was operated under ultrahigh purity nitrogen with a dew point of −78° C. The devices were driven using alternating polarity voltage pulses with an amplitude 60 volts above the threshold voltage for the onset of luminance for the devices and a repetition rate of 240 Hz. FIG. 4 shows the relative luminosity as a function of operating time in these environments. As can be seen from the data, the device operated in ultra-pure nitrogen showed substantially higher luminance and a low rate of luminance loss with increasing operating time. Further, the tests device operated in the 5% relative humidity atmosphere developed black spots upon aging whereas the test device operated under ultrahigh purity nitrogen did not. The data shows that either the polymer layer and/or the low humidity environment afforded higher luminance and better stability.

Example 2

Figure 5:
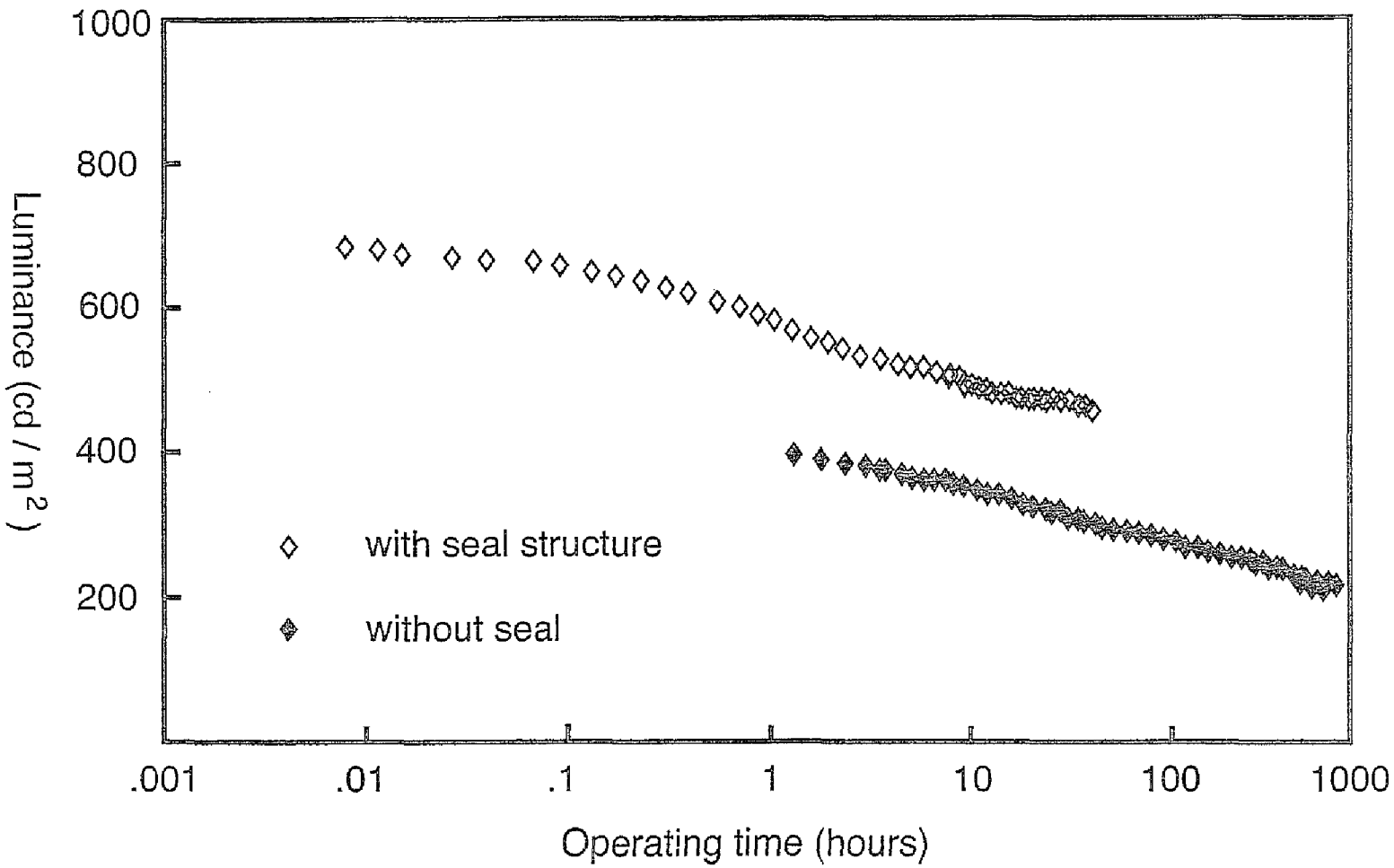
FIG. 5 is a graph illustrating the luminosity as a function of operating time for a thick film dielectric electroluminescent display incorporating a laminated seal as compared to that of a similar display without the laminated seal.

In this example two test devices similar to those of example 1 were tested. One of the devices had a laminated sealing structure of a one micrometer thick polymer layer deposited using the methods of example 1 covered with a 1 micrometer thick layer of amorphous silicon nitride deposited using a sputtering or low temperature chemical vapour deposition method. The other device was identical to the devices of example 1. The device with the laminated sealing structure was operated using the same drive method as in example 1 in an ambient environment of air at 22° C. and a relative humidity of 40%. The device without the laminated sealing structure was operated at 22° C. in a less moist atmosphere having a relative humidity of 5%. The luminance as a function of operating time is shown for both devices in FIG. 5. As can be seen from the data, the device with the sealing structure including a silicon nitride layer had significantly higher luminance and a low rate of luminance decrease with increasing operating time, despite the higher humidity of the operating environment. Further, the test device with the sealing structure including a silicon nitride layer did not develop black spots upon aging.

Example 3

Figure 6:
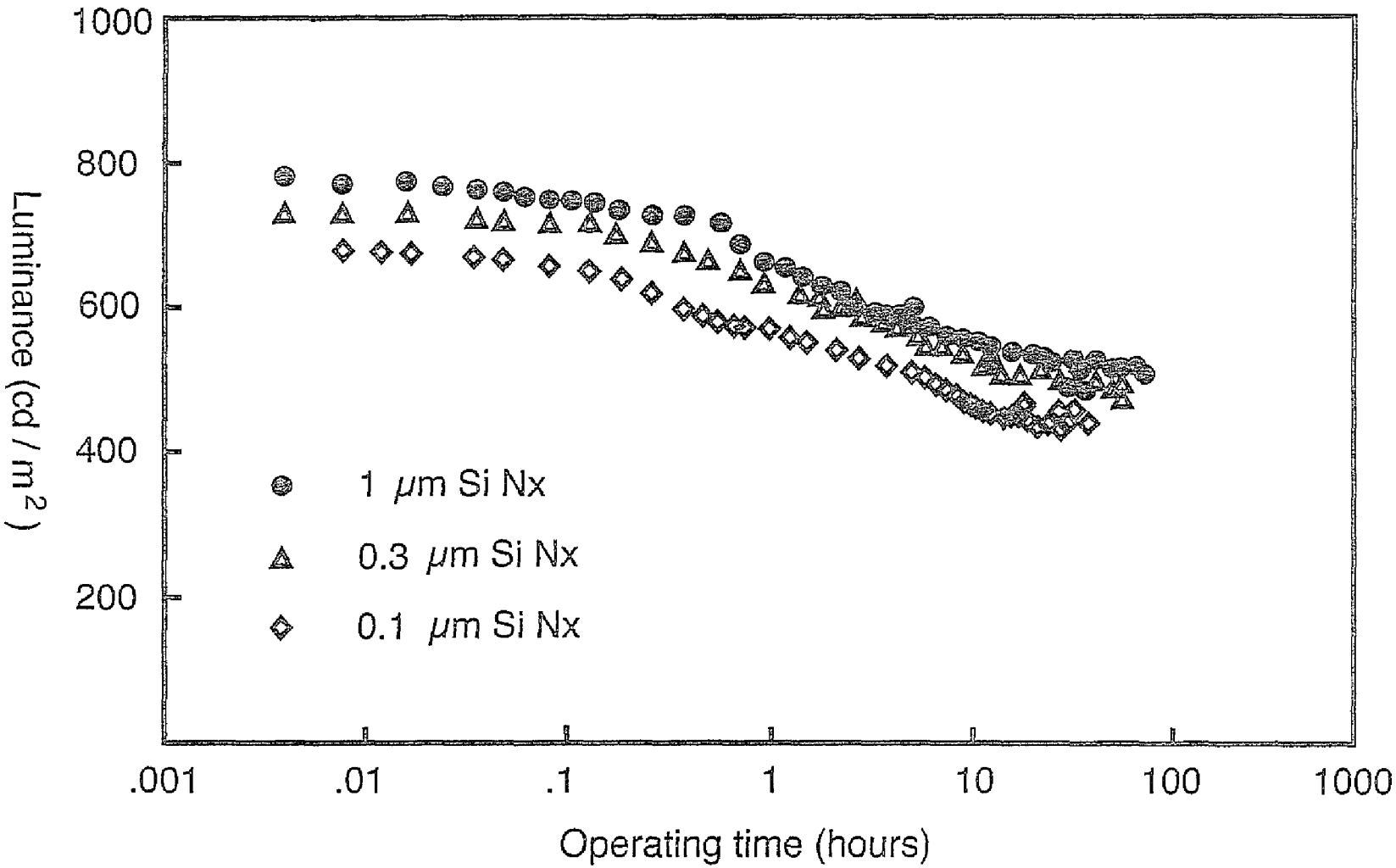
FIG. 6 is a graph illustrating the luminosity as a function of operating time for electroluminescent displays incorporating the laminated seal of the present invention having various thicknesses for the upper inorganic layer.

In this example, three devices similar to the device in example 2 with the sealing structure but respectively with a silicon nitride layer thickness of 0.1 micrometer, 0.3 micrometer and 1 micrometers were constructed and tested. The luminance as a function of operating time is shown in FIG. 6. As can be seen from the data, the luminance of the devices with the thicker silicon nitride layers was higher, indicating the increasing efficiency of the thicker silicon nitride layers in preventing moisture diffusion into the devices.

Example 4

This example serves to illustrate that a color conversion layer may be overlaid with an optically transparent inorganic layer of silicon nitride without significant diminution of the light emitted from the color conversion layer or shift of the CIE color coordinates of the emitted light. Two 5 centimeter by 5 centimeter glass substrates were each coated with areas of red and green photoluminescent color conversion films according to the methods taught in International Patent Application WO 2004/026000 and U.S. Provisional Application 60/560,602 (the disclosures of which are incorporated herein in their entirety). The photoluminescent films on one substrate were each coated with a 300 nanometer thick silicon nitride layer and the films on the other substrate were left uncoated. The films were illuminated with a blue filtered light emitting diode with CIE color coordinates x=0.138 and y=0.07. The uncoated green-emitting film had a normalized emission intensity of 1.0 and CIE coordinates of x=0.290 and y=0.665 and the silicon nitride coated green-emitting film had a comparative emission intensity of 0.89 and CIE coordinates of x=0.292 and y=0.658. The uncoated red-emitting film had a normalized emission intensity of 1.0 and CIE coordinates of x=0.614 and y=0.327 and the silicon nitride coated red-emitting film had a comparative emission intensity of 0.87 and CIE coordinates of x=0.601 and y=0.324. Thus the silicon nitride layer absorbed or reflected only a minimal fraction of the emitted green or red light and had no significant effect on the CIE color coordinates.

Although preferred embodiments of the invention have been described herein in detail, it will be understood by those skilled in the art that variations may be made thereto without departing from the spirit of the invention.

The invention claimed is:

1. An electroluminescent display comprising, in sequence:
a substrate;
a blue light-emitting addressable electroluminescent pixel array on said substrate; and
a laminated seal comprising a photoluminescent color conversion layer that converts blue light from at least some of the pixels in the pixel array to visible light of a different color in proximity to and aligned with the sub-pixels of said pixel array and an optically transparent inorganic amorphous film layer adhered over said color conversion layer, wherein said display is a thick film electroluminescent display.

2. The display of claim 1, wherein said pixel array comprises in sequence;
a lower electrode;
a thick film dielectric layer;
a smoothing layer;
a thin film dielectric layer;
phosphor layer;
upper thin film dielectric layer; and
upper electrode.

3. The display of claim 1, wherein said inorganic amorphous film layer comprises a material selected from the group consisting of inorganic metal oxides, metal nitrides, metal oxynitrides, metal oxyborides, metal silicides, metal silicates and metal carbides and combinations thereof.

4. The display of claim 3, wherein said inorganic amorphous film layer is selected from the group consisting of silica, alumina, titania, indium oxide, tin oxide, indium tin oxide, tantalum oxide, zirconium oxide, chromium oxide, zinc oxide, aluminum nitride, silicon nitride, boron nitride, germanium nitride, chromium nitride, nickel nitride, boron carbide, tungsten carbide, silicon carbide, aluminum oxynitride, silicon oxynitride, boron oxynitride, zirconium oxyboride, titaniumoxyboride, silcon aluminum oxynitrode (SiAlON), aluminum oxynitride (AlON) and combinations thereof.

5. The display of claim 3 wherein said inorganic amorphous film layer is selected from the group consisting of silicon nitride, silicon carbide, silicon oxynitride, silicon aluminum oxynitride (SiAlON) and aluminum oxynitride (AlON) and combinations thereof.

6. The display of claim 3, wherein said inorganic amorphous film layer is silicon nitride, silicon oxynitride or combinations thereof.

7. The display of claim 1, wherein the thickness of the inorganic amorphous film layer is about 0.01 to 2 micrometers.

8. The display of claim 3, wherein said thickness is about 0.05 to 1 micrometers.

9. The display of claim 1, wherein said color conversion layer comprises a fluorescent pigment particle composition dispersed within a UV curable resin.

10. The display of claim 9, wherein said pigment particle composition comprises at least one dye and a polymeric material with an optional molecular additive.

11. The display of claim 1, further comprising a perimeter seal contacting and extending from said substrate and to a cover plate to inhibit exposure of the electroluminescent display structure to an atmospheric contaminant.

12. An electroluminescent display comprising in sequence:
a substrate;
a blue light-emitting addressable electroluminescent pixel array on said substrate;
an optically transparent laminated seal that comprises a lower polymer layer deposited on and adhered to said pixel array and an upper inorganic amorphous film layer deposited on said lower polymer layer;
a photoluminescent color conversion layer that converts blue light from at least some of the pixels in the pixel array to a different color of visible light and adhered to the laminated seal and aligned with the sub-pixels of said pixel array; and
an optically transparent inorganic sealing layer adhered to said color conversion layer, wherein said display is a thick film electroluminescent display.

13. The display of claim 12, wherein said pixel array comprises in sequence;
a lower electrode;
a thick film dielectric layer;
a smoothing layer;
a thin film dielectric layer;
phosphor layer;
upper thin film dielectric layer; and
upper electrode.

14. The display of claim 12, wherein said inorganic amorphous film layer comprises a material selected from the group consisting of inorganic metal oxides, metal nitrides, metal oxynitrides, metal oxyborides, metal silicides, metal silicates and metal carbides and combinations thereof.

15. The display of claim 12, wherein said inorganic amorphous film layer is selected from the group consisting of silica, alumina, titania, indium oxide, tin oxide, indium tin oxide, tantalum oxide, zirconium oxide, chromium oxide, zinc oxide, aluminum nitride, silicon nitride, boron nitride, germanium nitride, chromium nitride, nickel nitride, boron carbide, tungsten carbide, silicon carbide, aluminum oxynitride, silicon oxynitride, boron oxynitride, zirconium oxyboride, titaniumoxyboride, silcon aluminum oxynitrode (SiAlON), aluminum oxynitride (AlaN) and combinations thereof.

16. The display of claim 14 wherein said inorganic amorphous film layer is selected from the group consisting of silicon nitride, silicon carbide, silicon oxynitride, silicon aluminum oxynitride (SiAlON) and aluminum oxynitride (AlaN) and combinations thereof.

17. The display of claim 15, wherein said inorganic amorphous film layer is silicon nitride or silicon oxynitride.

18. The display of claim 12, wherein the thickness of the inorganic amorphous film layer is about 0.01 to 2 micrometers.

19. The display of claim 12, wherein said thickness is about 0.05 to 1 micrometers.

20. The display of claim 12, wherein said color conversion layer comprises a fluorescent pigment particle composition dispersed within a UV curable resin.

21. The display of claim 20, wherein said pigment particle composition comprises at least one dye and a polymeric material with an optional molecular additive.

22. The display of claim 12, further comprising a perimeter seal contacting and extending from said substrate and to a cover plate to inhibit exposure of the electroluminescent display structure to an atmospheric contaminant.

23. A sealed electroluminescent display comprising in sequence:

a substrate;

a thick film dielectric electroluminescent display structure provided on the substrate;

a laminated seal provided within the display provided above said thick film dielectric electroluminescent display structure, the laminated seal comprising a lower polymer layer and an upper inorganic amorphous film layer deposited on the lower layer, wherein the lower layer of the seal structure provides a means to absorb or react with vapors emanating from the display structure so as to substantially prevent a build-up of pressure between the upper moisture impervious layer of the sealing structure and the display structure that may cause fracture of the upper moisture-impervious layer.

* * * * *